US012227942B2

(12) United States Patent
Yang

(10) Patent No.: US 12,227,942 B2
(45) Date of Patent: Feb. 18, 2025

(54) STEEL-STRUCTURE BUILDING ENVELOPE

(71) Applicant: Feng-Yi Yang, Kaohsiung (TW)

(72) Inventor: Feng-Yi Yang, Kaohsiung (TW)

( * ) Notice: Subject to any disclaimer, the term of this patent is extended or adjusted under 35 U.S.C. 154(b) by 201 days.

(21) Appl. No.: 18/090,938

(22) Filed: Dec. 29, 2022

(65) Prior Publication Data

US 2024/0218662 A1 Jul. 4, 2024

(51) Int. Cl.
*E04B 5/23* (2006.01)
*E04B 2/84* (2006.01)

(52) U.S. Cl.
CPC ..... *E04B 5/23* (2013.01); *E04B 2/84* (2013.01); *E04B 2005/232* (2013.01)

(58) Field of Classification Search
CPC ..... E04B 2/56; E04B 2/58; E04B 2/84; E04B 1/24; E04B 2001/2481; E04B 2001/2484; E04B 2001/2684
USPC ..... 52/79.1, 236.3, 236.6, 236.7, 293.3
See application file for complete search history.

(56) References Cited

U.S. PATENT DOCUMENTS 2,457,982 A * 1/1949 Deichmann ..... E04C 2/386 52/270
2,947,119 A * 8/1960 Puckett, Jr. ..... E04B 7/045 52/713
3,736,709 A * 6/1973 Koch ..... E04B 1/04 52/236.7
3,827,200 A * 8/1974 Preissler ..... E04B 7/028 52/236.1
4,186,535 A * 2/1980 Morton ..... E04B 1/98 52/250
4,285,173 A * 8/1981 Grearson ..... E04B 5/40 52/250
4,333,280 A * 6/1982 Morton ..... E04B 1/98 52/250
4,488,385 A * 12/1984 Teasel ..... E04B 2/84 52/444
4,507,901 A * 4/1985 Carroll ..... E04D 13/1606 52/404.3
4,669,240 A * 6/1987 Amormino ..... E04B 1/04 52/745.1

(Continued)

FOREIGN PATENT DOCUMENTS

CN 2608583 Y 3/2004
CN 206737130 U 12/2017

(Continued)

*Primary Examiner* — Paola Agudelo
(74) *Attorney, Agent, or Firm* — Rosenberg, Klein & Lee

(57) ABSTRACT

A steel-structure building envelope includes a building body, floor slabs, and external walls. The building body has H beams and decks. The decks are assembled onto the H beams. The floor slabs have RC slabs laid on the decks. The external walls each have an RC curb formed on the RC slab by means of casting, two steel C profiles, one of which is installed on the RC curb with an opening thereof facing upward, and the other of which is mounted on the deck with an opening thereof facing downward; and an outer wall panel and an inner wall panel, attached to opposite sides of the RC curb and the two steel C profiles, respectively, so that a hollow space is formed between the outer wall panel and the inner wall panel. Thereby the external walls have a two-layer structure and are affixed directly to the floor slabs.

11 Claims, 10 Drawing Sheets

(56) References Cited

U.S. PATENT DOCUMENTS 4,700,519 A * 10/1987 Person ..... E04B 5/40 52/334
4,918,897 A * 4/1990 Luedtke ..... E04B 1/16 52/657
5,357,721 A * 10/1994 Alvarez ..... E04B 7/04 52/93.2
5,359,816 A * 11/1994 Iacouides ..... E04B 1/0007 52/236.7
5,592,796 A * 1/1997 Landers ..... E04B 2/7457 52/483.1
5,761,864 A * 6/1998 Nonoshita ..... E04D 13/17 52/95
6,279,287 B1 * 8/2001 Meadows ..... E04C 2/296 52/309.9
7,389,620 B1 * 6/2008 McManus ..... E04B 5/40 52/414
7,647,742 B2 * 1/2010 Han ..... E04C 3/34 52/741.1
8,109,056 B2 * 2/2012 Hashimoto ..... E04B 1/08 52/236.7
8,161,697 B1 * 4/2012 McDonald ..... E04C 2/16 428/292.4
8,245,480 B2 * 8/2012 Studebaker ..... F16B 33/06 52/289
8,458,973 B1 * 6/2013 Powers, Jr. ..... E04C 3/20 52/432
8,733,046 B2 * 5/2014 Naidoo ..... B32B 13/02 52/309.7
10,138,630 B1 * 11/2018 Sarda ..... E04B 2/86
10,995,497 B1 * 5/2021 Horne ..... E04D 1/34
11,078,682 B1 * 8/2021 diGirolamo ..... E04B 1/2403
2003/0056445 A1 * 3/2003 Cox ..... E04D 13/15 52/62
2005/0210798 A1 * 9/2005 Burg ..... E04B 2/7457 52/481.1
2008/0295441 A1 * 12/2008 Carolan ..... E04C 2/292 52/633
2009/0090074 A1 * 4/2009 Klein ..... E04B 2/7411 52/232
2010/0218443 A1 * 9/2010 Studebaker ..... E04B 1/215 52/698
2011/0277407 A1 * 11/2011 Masure ..... E04C 2/296 52/309.4
2015/0167289 A1 * 6/2015 Wang ..... E04H 1/04 52/745.19
2016/0376787 A1 * 12/2016 Grisolia ..... E04B 2/707 52/236.3
2018/0038099 A1 * 2/2018 Barnes ..... E04C 3/02
2021/0277653 A1 * 9/2021 Pospisil ..... E04B 5/10
2023/0085256 A1 * 3/2023 Ohuchi ..... E04H 9/021 52/236.6

FOREIGN PATENT DOCUMENTS

CN 212582970 U 2/2021
CN 113605554 A 11/2021

* cited by examiner

STEEL-STRUCTURE BUILDING ENVELOPE

BACKGROUND OF THE INVENTION

1. Technical Field

The present invention relates to steel-structure buildings, and more particularly to a steel-structure building envelope which has external walls affixed directly to floor slabs, so that the floor slabs effectively separate spaces of upper and lower stories with enhanced acoustic/thermal insulation and waterproofing, thereby making steel-structure buildings using the building envelope ideal for residential use.

2. Description of Related Art

Ancient residential buildings in Taiwan were mostly constructed using bricks, and modern residential buildings started to be popular after ferroconcrete constructing technologies were introduced and commoditized in Taiwan. In recent years, with the increase of economic development, population density, and in turn land costs, more and more steel-construction skyscrapers have been built for not only business use but also residential use. According to statistics, residential buildings form a staple part, taking up more than ninety percent, of all buildings in Taiwan.

In general, there are three structural types of modern buildings in Taiwan, i.e., RC (reinforced concrete), SS (steel structure), and SRC (steel reinforced concrete).

An RC structure is built on a structure modeled using formwork pieces, and constructed through assembling reinforcing bars and pouring concrete, so that the resulting structure can have both the desired tensile strength of reinforcing bars and the desired compressive strength of concrete. This is the staple construction method currently used in the construction industry in Taiwan. More than 90% of all existing buildings (including residential buildings and business buildings) in Taiwan were bult using this method, and almost 100% among low- to mid-height buildings (5- to 15-story buildings) are of this type. For 40 years, residential buildings in Taiwan were mostly built as RC structures. Since seismic activities are frequent in Taiwan, if an earthquake happens during the grouting stage of an RC construction, the bond strength between concrete and reinforcing bars can be significantly degraded, seriously affecting the resulting structural strength. Additionally, due to the weather conditions in Taiwan, the constructed RC structures are mostly exposure in hot and humid environments. Consequently, water can accumulate in concrete over time and dissolve hydration product contained in concrete, leading to increased porosity or pore connectivity in concrete. Besides, when contacting carbon dioxide in the air for a long period, concrete can undergo carbonatation, which accelerating corrosion of reinforcing bars. Such corrosion can make reinforcing bars swell to crack or spall (bulge) the concrete. This change of concrete and efflorescence in appearance will make tiles fall off, decrease the load-bearing capacity and shock resistance of the concrete structure, and directly prevent normal living use and endanger safety of the building. Therefore, an RC building has a relatively use life cycle, about 30 to 50 years. Great numbers of RC buildings were built all around Taiwan to accommodate the populations rapidly increasing with economic development, and many of these RC buildings are now about to reach the end of their life cycles. For ensuring living safety, local governments are vigorously promote reconstruction of urban unsafe and old buildings. However, as it is known that reconstruction of residential buildings is particularly complicated and difficult, many people are still living in unsafe and old RC residential buildings.

A steel structure (SS), constructed by assembling steel segments, features for good toughness and shock resistance, and is usually used in skyscrapers, which need to be particularly earthquake-resistant because seismic forces can be significantly magnified therein. Taiwan is in an earthquake zone, and resilient designs are stipulated for any building having more than 30 stories according to laws. However, columns and beams in an RC structure with a resilient design are usually bulky and prevent efficient use of interior spaces of the building (particularly in the basement and the first to eighth floors). Thus, business building or public buildings (e.g., department stores, hotels, long-span stadiums, and factories) are usually SS buildings. While an SS building tends to shank in strong winds, this issue can be well addressed by using diagonal bracing and wall dampers to reduce possible displacement to 2/1000, even lower than an RC building displacement.

An SRC building is based on a basic structure constructed from steel column and steel beams. Reinforcing bars are then assembled around the basic steel structure for formworks to be built thereon. At last, concrete is poured into the formworks to form the beam columns and floor slabs. The SRC method was developed to provide the comfort required in residential buildings by combine the pressure resistance of RC (increasing rigidity to prevent buildings from shaking under earthquake force and wind force) and the shock resistance of SS (increasing toughness to enhance resistance to earthquake force). However, an SRC structure is not superior to an RC structure in terms of structural strength because the both are enclosed by reinforced concrete that is incapable of energy dissipation mechanism. In brief, SRC structures are disadvantageously related to repeated works (steel columns and beams+RC enclosure), increased construction costs, long construction cycles, and less efficiency.

Moreover, due to population growth and industrial development, greenhouse gas has increased menacingly and degrades our living environment. Professor Hsien-Te Lin of Department of Architecture National in Cheng Kung University has published the following words in Business Today (a magazine circulated in Taiwan) as a part of the chapter of "The Sustainable Environment" on Dec. 15, 2021: According to a report of the United Nations Environment Programme (UNEP) published in 2020, the construction industry is responsible for 35% of the total energy consumption and 38% of the total greenhouse gas emission of the world in 2019, higher than the combination of the sectors of industry and transportation. Therefore, energy conservation and emissions reductions of the construction industry is an important indicator that how well a country controls greenhouse gas emission and warming in its journey to net zero emissions. For reducing greenhouse gas emission, governments have been promoting and legislating for low-emission "green buildings," with the attempt to improve the status quo in various aspects of the construction industry, including design, construction, operation & use, demolition (resources renewal or waste disposal). EEWH, i.e., the green building certification system in Taiwan, look at nine major indicators for evaluation, including biodiversity, foliage, water conservation, energy savings, carbon dioxide emissions reduction, construction waste reduction, indoor environmental quality, water soil content, and garbage and sewage improvements. The Legislative Yuan in Taiwan officially released "Taiwan's Pathway to Net-Zero Emissions in 2050 and General Explanation of Related Strategies" in March 2022, providing that 100% newly constructed buildings and more than 85% existing buildings will be transformed gradually into zero-carbon buildings by 2050.

Among RC, SS and SRC, RC buildings emit most carbon during construction, more than two times of the of SS buildings. Besides, after demolition of RC buildings due to end of life or other reasons, the used concrete is less recyclable, opposite to the highly reusable steel materials collected during demolition of SS buildings. It is thus apparent that SS buildings are advantages for low energy consumption and low carbon emission. Despite of this, except for construction of skyscrapers, RC builds still dominate because the construction cost for SS is about 1.3 times of that for RC. In Taiwan, SRC is extensively adopted for residential skyscrapers in addition to SS. This is because: 1. RC, as a wet construction method, is easier than dry wet construction methods using steel parts in terms of interface processing details; 2. There is a myth that the combination of steel columns and steel beams covered by RC provides a once-and-for-all solution that satisfies requirements about fire retardation, waterproofing, rust prevention, acoustic insulation, and weather resistance. In fact, SRC is environmentally the worst performer, yet it has no advantages about stress bearing and constructive facilities. Besides, SRC, like RC, is subject to concrete degradation, yet is not as resistant to shocks as SS is.

While construction of SS buildings is more expensive than that of RC buildings, the use costs for the two kinds of buildings are about the same because the theoretical life of an SS building can be as long as 100 years. Nevertheless, Mr. Yen-Chung Huang in his paper titled "The Planning and Design of E-Procurement System of Steel Making Industrial" argues that "According to the statistics from OECD (Organization for Economic Co-Operation and Development), the construction industry is worldwide one of the largest industries, contributing to 13.4% of the global GDP, about 7.5 trillion dollars (WSA 2013). Meanwhile, the construction industry consumes more than 50% of the worldwide steel production . . . in Taiwan, steel consumption for construction use was only about 5.0% to 7.5% of the Taiwan's total steel production, i.e., 34 million tons, in 2013, and the number is far from the share of 30% to 40% in advanced countries like some Europe countries, the US, and Japan (2010) (even higher than 85% in the Nordic countries). Since the 1999 Jiji earthquake, with increased awareness of resistance to earthquakes and safety for residential buildings, a growing proportion of both residential and non-residential buildings have been constructed with steel structures. In view that carbon reduction and sustainability have become worldwide expectations, steel is obviously the optimal sustainable material for sustainable buildings as it not only is effective in carbon reduction but also has an excellent cyclical use rate, more than 90%." It is thus believed that there is still a large room for SS building to increase in Taiwan.

Referring to FIG. 8 through FIG. 10, in traditional SS buildings, external walls are typically curtain walls 10. Curtain walls 10 have light own weights, and are made modular so as to be easily assembled. To assemble curtain walls 10, curtain walls 10 are fixed to a steel structure through joining components 20. The steel structure is composed of H beams 30 and decks 40. RC slabs 50 are laid on the decks 40, and the decks 40 together with the RC slabs 50 act as floor slabs, so that the curtain walls 10 are hung outside the floor slabs by the joining components 20.

For SS buildings to be more economic and more comfortable for residential use, the following issues have to be addressed:

1. Inter-story drift: calculation of the inter-story drift of curtain walls 10 is based on the height of the entire building, and for calculation of the inter-story drift of a set of curtain walls 10, the displacement of the total height of the set as to be referred, so the displacements of different sets are interplaying and the related consideration is relatively complicated.
2. Fire protection stuffing: to completely separate upper and lower stories intermediated by floor slabs, gaps formed between assembled curtain walls 10 and floor slabs have to be filled with perimeter fire barriers 60 and closed by closing plates.
3. Interior and exterior waterproofing: in a business building, pipe shafts, elevators, toilets, pantry rooms, and kitchens are gathered in areas known as "service cores." Theses water zones where water is used are usually such arranged that they are away from gaps between curtain walls 10 and floor slabs so as to facilitate arrangement of water supply pipes and drainage pipes. However, a residential building can need more and distributed water zones, such as toilets, bathrooms, balconies, and kitchens, making arrangement of water supply pipes and drainage pipes difficult and adding extra waterproofing works between upper and lower stories.
4. Acoustic/thermal insulation: depending on the materials of the curtain external walls 10, extra backing materials may need to be used to making the curtain walls 10 competent in acoustic insulation or thermal insulation, and the materials of the curtain external walls 10 may cause solid-borne sound transmission or thermal conduction themselves.
5. Maintenance of external walls: curtain walls 10 may need to be enhanced by additional insulating or backing materials to provide competent acoustic insulation or thermal insulation, and this adds difficulties in maintenance and renewal of the curtain walls 10.

According to the above, residential buildings are more demanding in living comfort, and therefore expected to provide good performances in waterproofing, airtightness, acoustic insulation, and seismic isolation. To satisfy all these requirements, the cost for constructing SS residential buildings can be significantly increased, making SS a less economic option in low-height residential buildings.

SUMMARY OF THE INVENTION

Steel structures can provide longer service life of buildings and meet the requirements for green buildings. In Taiwan, residential buildings take more than 90% of all types of buildings. For making steel structures more suitable for residential buildings, helpful to extend service life of residential building, and contributive to net zero emissions, the present invention provides a steel-structure building envelope of a steel-structure building, comprising:

a building body, having H beams and decks, the decks being assembled onto the H beams, floor slabs, comprises RC slabs laid on the decks, so that the decks and the RC slabs jointly act as the floor slabs, external walls, each comprising: an RC curb, formed on the RC slab by means of casting; two steel C profiles, one of which is installed on the RC curb with an opening thereof facing upward, and the other of which is mounted on the deck with an opening thereof facing downward; an outer wall panel and an inner wall panel, attached to opposite sides of the RC curb and the two steel C profiles, respectively, so that a hollow space is formed between the outer wall panel and the inner wall panel. Thereby the external walls have a two-layer structure and are affixed directly to the floor slabs.

Further, two rockwool strips are attached to the two steel C profiles, respectively, and partially received in the hollow space, so that the two rockwool strips extend along a height direction of the external walls. Further, the two rockwool strips each extend along the height of the external walls C while being bent into a continuous S-shaped form.

Further, the H beams are arranged at an indoor side of the building and adjacent to the outer wall panels, and each of the outer wall panels is attached to the RC curb, the two steel C profiles, and the two rockwool strips from an end of the floor slab. Further, a transverse aluminum extrusion is arranged between the two outer wall panels that are adjacent to each other in a height direction thereof, and silicone is filled between the transverse aluminum extrusion and the two outer wall panels.

Further, the H beams are arranged at the indoor side of the building and adjacent to the outer wall panels, and the floor slabs jut out of an outdoor side of the outer wall panels.

Further, the H beams are arranged at the outdoor side of the building and adjacent to the outer wall panels. Furthermore, each of the H beams is peripherally enclosed by a galvanized square pipe, and a concrete panel is then attached to an outmost part of the galvanized square pipe.

Further, elastic cement is injected to fill assembly gaps between the adjacent outer wall panels.

Further, a waterproof layer is applied to coat the outer wall panels of the entire steel-structure building, and further painted with natural paint.

With the foregoing features, the present invention provides the following advantages:

1. Inter-story drift: since the external walls in the present invention are erected directly on floor slabs, and the floor slabs can completely separate the space of the upper story from the space of the lower story, the inter-story drift that is calculated on the basis of the story height can be reduced. For example, assuming that the story height is 3.2 m, and the displacement of the entire building is 1/1000, the inter-story drift of the current story is calculated by multiplying 3.2 m by 1/1000, which is 3.2 mm, so the resulting inter-story drift is very small.
2. Fire protection stuffing: since the external walls in the present invention are erected directly on floor slabs, the floor slabs can completely separate the space of the upper story from the space of the lower story, thereby eliminating the need of using perimeter fire barriers between external walls and floor slabs. In addition, the floor slab itself is a fireproof structural layer, thereby eliminating the need of additional exterior closing plates or cover plates.
3. Interior and exterior waterproofing: since the external walls in the present invention are erected directly on floor slabs, the floor slabs can completely separate the space of the upper story from the space of the lower story, so the floor slab itself is a good water cut-off layer, making arrangement of water supply pipes and drainage pipes for distributed "water zones" (i.e., such as toilets, bathrooms, balconies, and kitchens) in a residential building easier.
4. Acoustic/thermal insulation: since the external wall in the present invention has a two-layer structure formed by an outer wall panel and an inner wall panel, a hollow space can be formed between the outer wall panel and the inner wall panel, which can be further filled with rockwool. The hollow space can act as an extra air layer to break noise and heat transfer, thereby providing even improved acoustic insulation and thermal insulation.
5. Maintenance of external walls: the external walls in the present invention include aluminum extrusions at inter-story seams as physical caulking, so the use of silicone can be reduced, thereby facilitating maintenance and saving costs.

DETAILED DESCRIPTION OF THE INVENTION

The embodiments described below are intended to illustrate the disclosed building envelope of the present invention, but not to limit the scope of the present invention. Therein, since the building envelope is huge in volume, features are presented in local, close-up views for explicitness.

Figure 1:
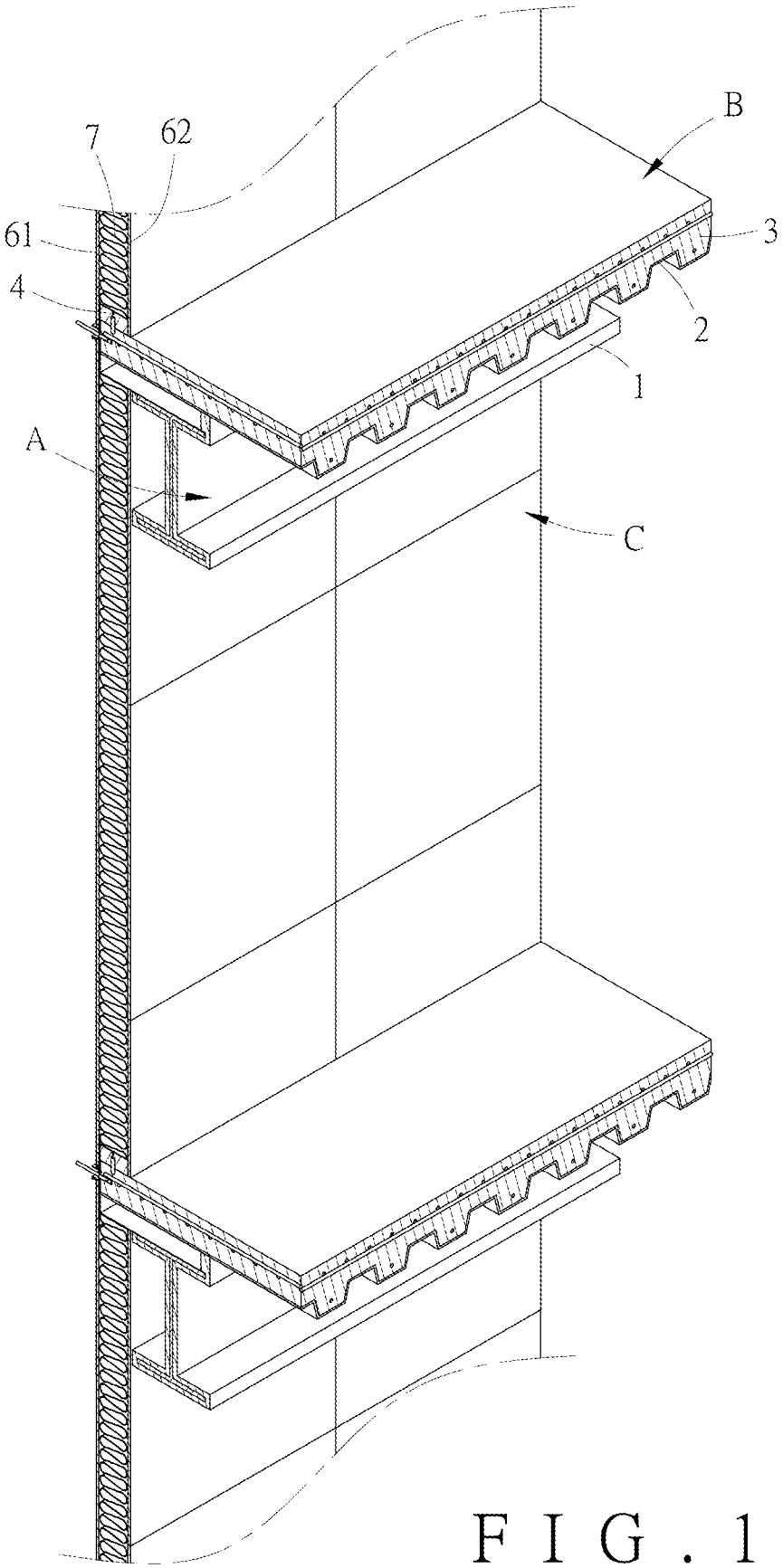
FIG. 1 is a local cutaway view of a steel-structure building envelope according to a first embodiment of the present invention taken from one view point.
Figure 2:
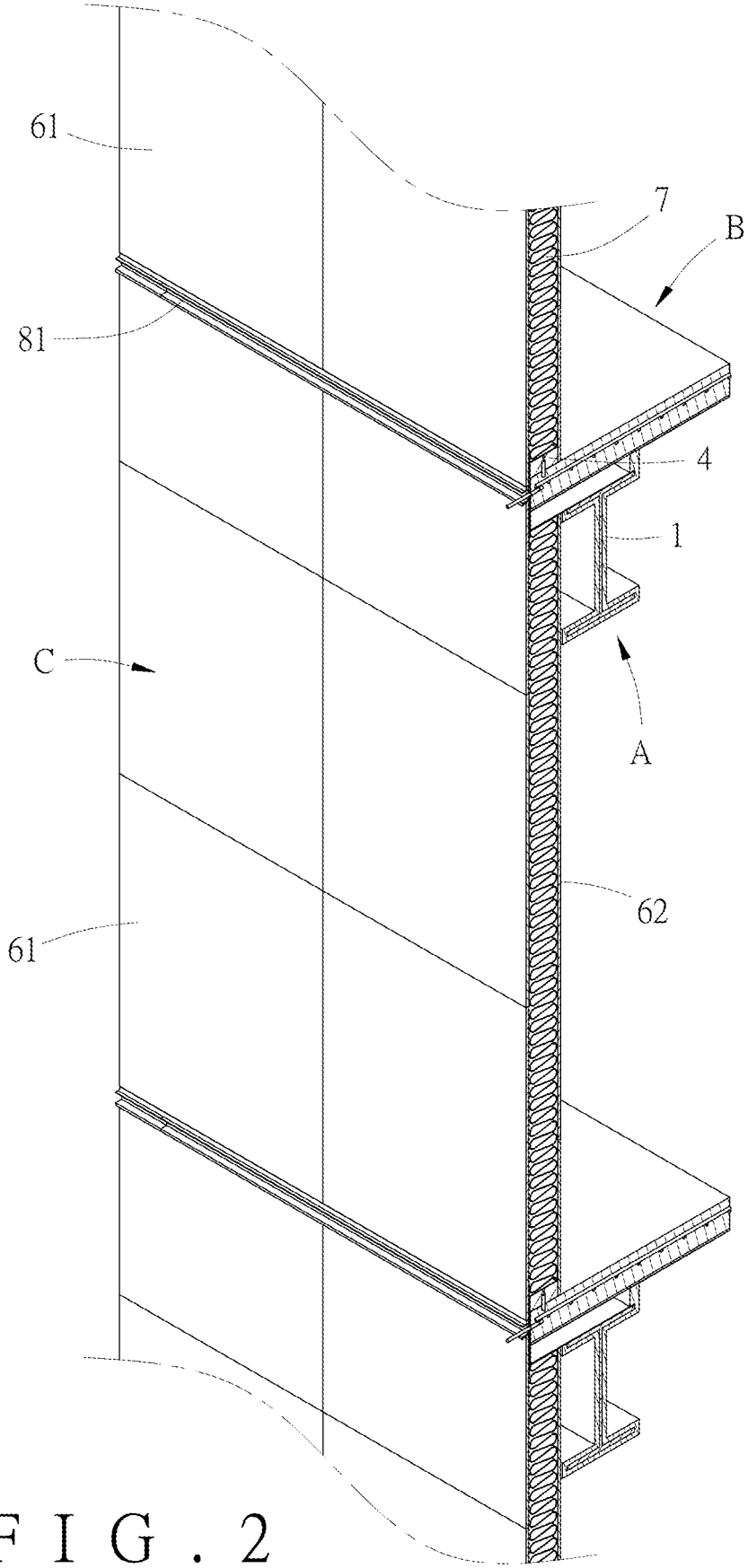
FIG. 2 is a local cutaway view of the steel-structure building envelope according to the first embodiment of the present invention taken from another view point.

In a first embodiment of the present invention, a steel-structure building envelope comprises a building body A, floor slabs B and external walls C, as shown in FIG. 1 and FIG. 2.

Figure 3:
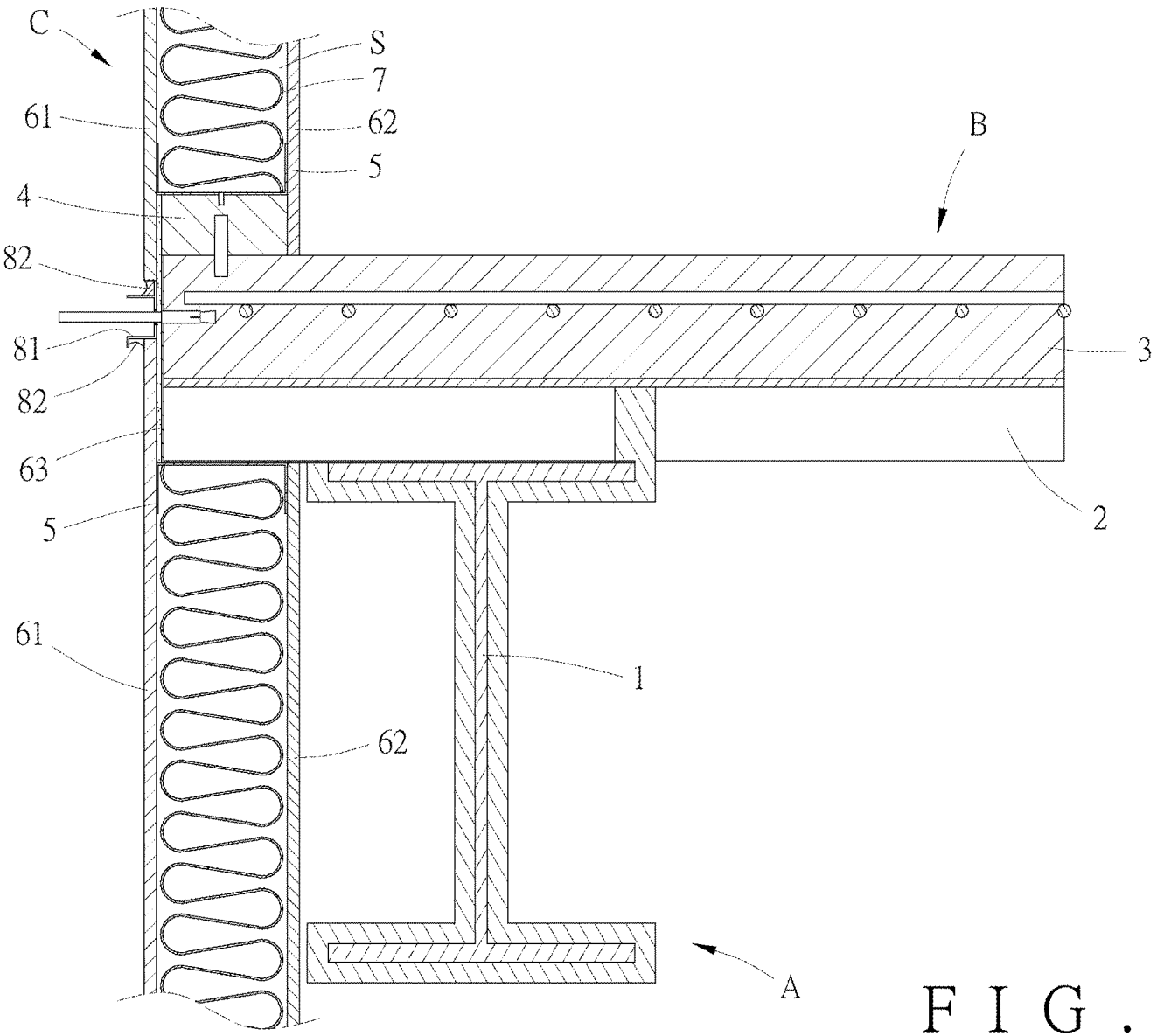
FIG. 3 is a local cross-sectional view of the steel-structure building envelope according to the first embodiment of the present invention.

Referring to FIG. 1 and FIG. 3, the building body A comprises H beams 1 and decks 2. The decks 2 are assembled onto the H beams 1. The floor slabs B comprises RC slabs 3 laid on the decks 2 so that the decks 2 and the RC slabs 3 jointly act as the floor slabs B. The external walls C each comprise: an RC curb 4, formed on the RC slab 3 by means of casting; two steel C profiles 5, one of which is installed on the RC curb 4 with an opening thereof facing upward, and the other of which is mounted on the deck 2 with an opening thereof facing upward; an outer wall panel 61 and an inner wall panel 62, attached to opposite sides of the RC curb 4 and the two steel C profiles 5, so that a hollow space S is formed between the outer wall panel 61 and inner wall panel 62. Thereby, the external wall C has a two-layer structure and is affixed directly to the floor slab B. With the configuration, the floor slab B can completely separate the space of the upper story from the space of the lower story by providing good water cut-off and acoustic/thermal insulation between the upper and lower stories. Additionally, elastic cement 63 may be filled in assembly gaps between the adjacent outer wall panels 61, so as to enhance waterproofing between the indoor side and the outdoor side of the building. In the present embodiment, two rockwool strips 7 are attached to the two steel C profiles 5, respectively, and partially received in the hollow space S. The two rockwool strips 7 each extend along the height of the external wall C while being bent into a continuous S-shaped form. Thereby, with the hollow space S and the rockwool strips 7 inlaid in the two-layer structure of the external wall C, acoustic/thermal insulation between the indoor side and the outdoor side of the building is enhanced.

Referring to FIG. 2 and FIG. 3, in the present embodiment, the H beam 1 is arranged at the indoor side of the inner wall panel 62, the outer wall panel 61 is affixed to the RC curb 4, the two steel C profiles 5, and the two rockwool strips 7 from the end of the floor slab B. A transverse aluminum extrusion 81 is arranged between two outer wall panels 61 that are adjacent to each other in the height direction, and then silicone 82 is injected between the transverse aluminum extrusion 81 and the two outer wall panels 61. As compared to traditional integrated curtain walls that tend to break due to resonance when receiving force or shocks, the structure of the present invention has the adjacent outer wall panels 61 separated by the aluminum extrusions 81 so as to reduce the risk of force-based breakage of the outer wall panels 61 and decrease the amount of silicone 82 required for joining and sealing purposes. In the present invention, since the assembled outer wall panels 61 are level and flush to each other, instead of further tiling, the external walls C can be easily finished by covering the outer wall panels 61 across the surface of the building with waterproof coating and natural paint successively.

Construction of the present embodiment is implemented as below, with details identical or similar to those known by people skilled in the art of SS construction omitted in the description and left out from the drawings for not blurring characteristics of the present embodiment. The construction includes: (1) assembling steel box columns and H beams 1 for each story; (2) laying decks 2 and pour stops for each story; (3) setting the layout and piping; (4) laying reinforcing bars (or welded wire fabrics) for each story; (5) concreting the RC slab 3 for each story; (6) putting up scaffolds; (7) constructing RC curbs 4 (including rebar-planting and grouting); (8) setting layout of and installing Z-shaped iron parts; (9) applying fire-resistive coating to the steel box columns and the H beams 1 for each story; (10) setting out Type 125 steel C profiles (including the steel C profiles 5 in the external walls C) with predetermined intervals, performing vertical calibration, and fixing them in position for each story; (11) setting out Type 125 steel C profiles (including fitting transoms and fixing iron parts) at the facade of any opening, door, or window, wherein only when the distance to the site boundary is greater than 150 cm can a window or door to be set; (12) assembling concrete outer wall panels 61; (13) stuffing assembly gaps between the adjacent outer wall panels 61 with elastic cement 63 (stuffing assembly gaps between the adjacent outer wall panels 61 with tile gripper); (14) stuffing assembly gaps between the adjacent outer wall panels 61 with elastic cement 63 (closing the assembly gaps between the adjacent outer wall panels 61 with anti-crack nets); (15) arranging rockwool strips 7 along the height of the external walls C; (16) fastening concrete inner wall panels 62; (17) fastening aluminum window fittings; (18) installing aluminum window frames and doorframes; (19) caulking doors and windows; (20) installing drip lines for doors and windows; (21) constructing fire protection stuffing for all assembly gaps between the main body A, the floor slabs B, and the external walls C; (22) spraying waterproof coating on the outer wall panels 61 across the building; (23) installing the transverse aluminum extrusion 81 between the outer wall panels 61; (24) stuffing silicone 82 between the transverse aluminum extrusions 81 and the outer wall panels 61 and around the aluminum window frames and doorframes; (25) painting the outer wall panels 61 with natural paint; (27) removing the scaffolds; and (30) finishing construction of the external wall of the present story.

Figure 4:
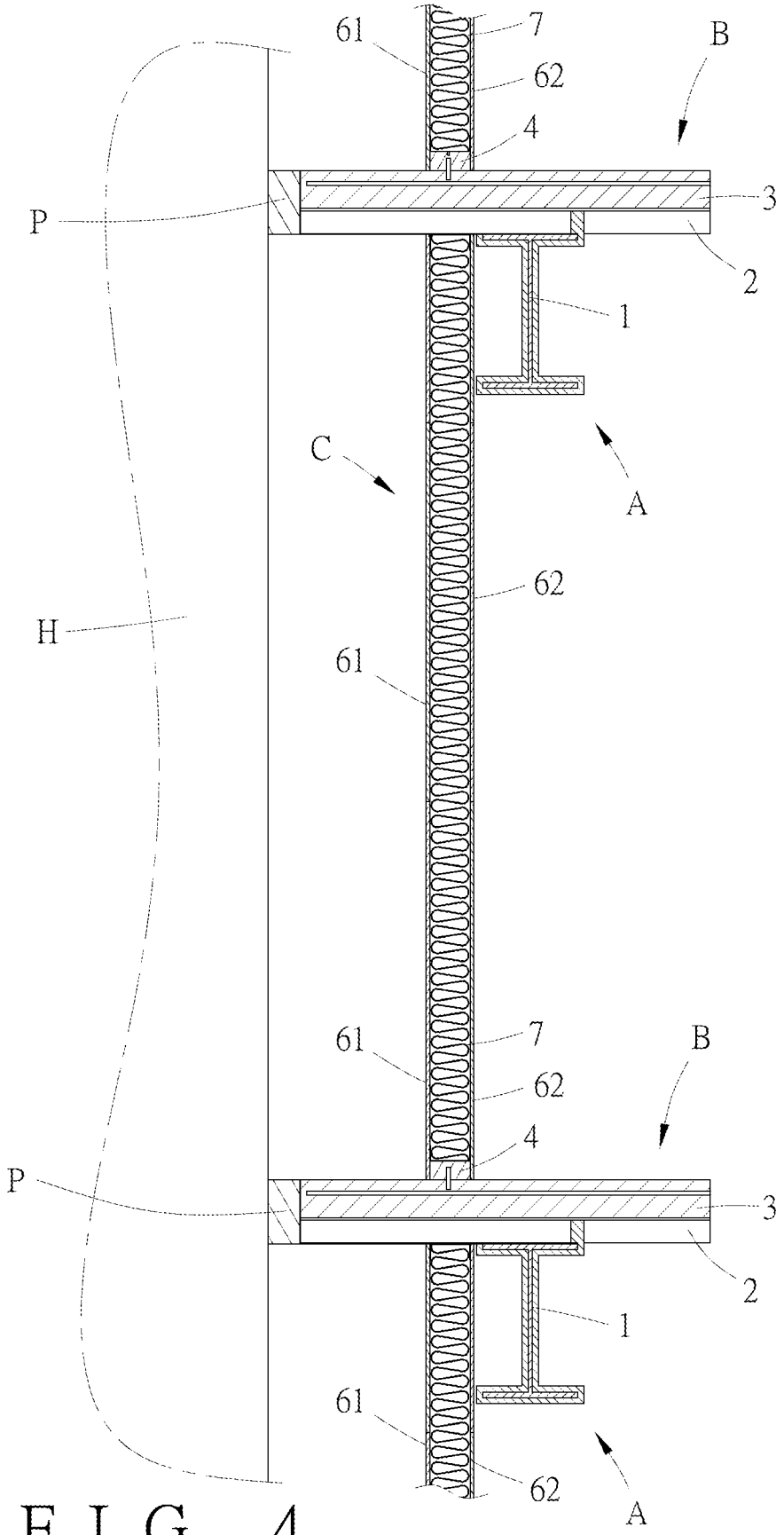
FIG. 4 is a local cross-sectional view of a steel-structure building envelope according to a second embodiment of the present invention.
Figure 5:
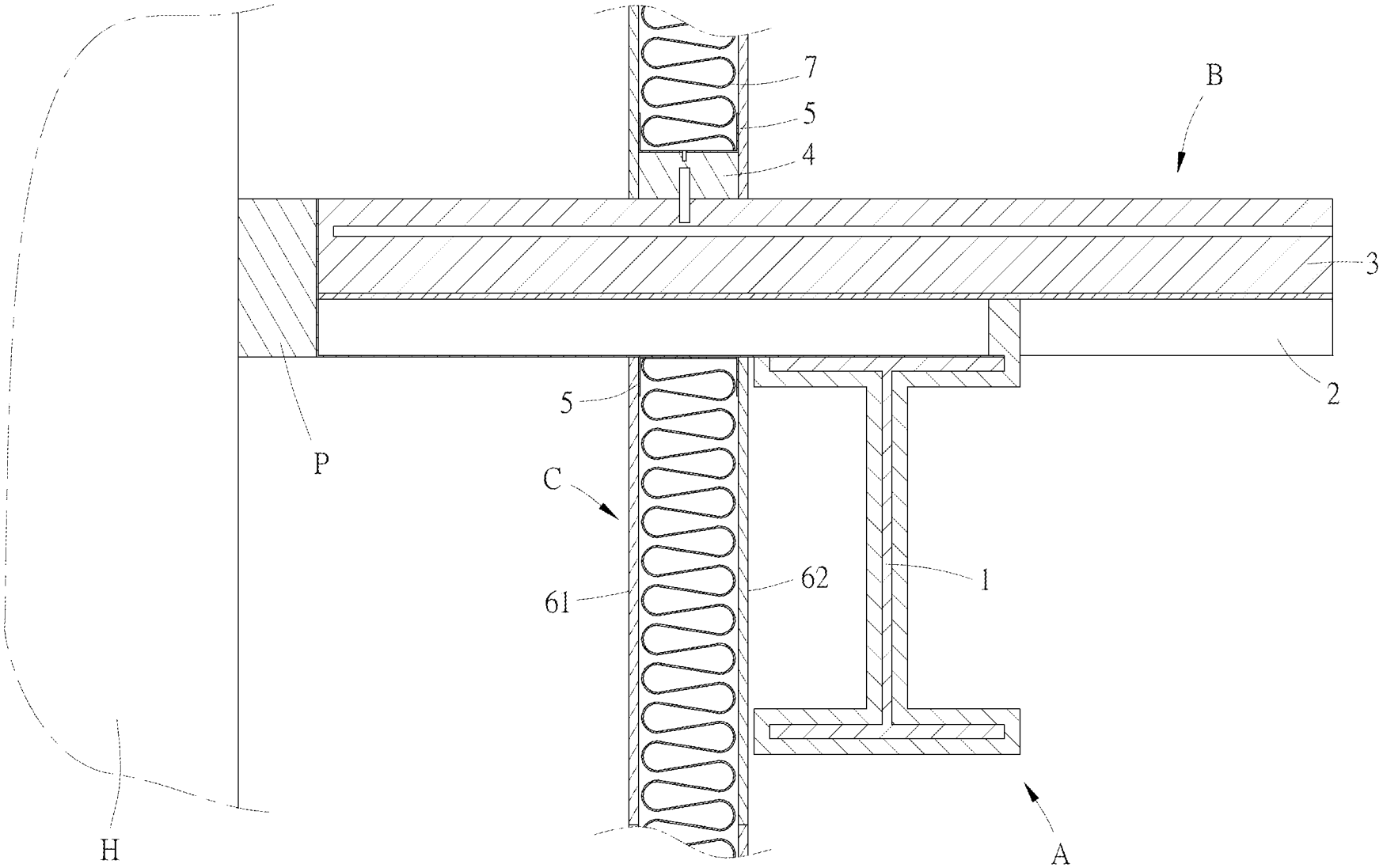
FIG. 5 is another local cross-sectional view of the steel-structure building envelope according to the second embodiment of the present invention.

In a second embodiment of the present invention, a steel-structure building envelope as shown in FIG. 4 and FIG. 5 is similar to the first embodiment except that the H beams 1 in the present embodiment are installed at the indoor side of the building and adjacent to the inner wall panels 62, and that the floor slabs B jut out of the outer wall panels 61 at the outdoor side so that the floor slabs B can act as decorative features, sunshades, rain shades, or footholds during construction. For example, for a construction site having an adjacent building H beside it, where the distance between the external wall C and the adjacent building H is greater than 50 cm and smaller than 100 cm, and it is difficult to set scaffolds, workers can move on the floor slabs B such configured instead of scaffolds. In addition, a plate P may be further arranged between the floor slab B jutting out at the outdoor side of the building and the adjacent building H to provide a buffering area to the adjacent building H during construction.

Construction of the present embodiment is implemented as below, with details identical or similar to those known by people skilled in the art of SS construction omitted in the description and left out from the drawings for not blurring characteristics of the present embodiment. (1) assembling steel box columns and H beams 1 for each story; (2) laying decks 2 and pour stops for each story; (3) setting the layout and piping; (4) laying reinforcing bars (or welded wire fabrics) for each story; (5) concreting the RC slab 3 for each story; (6) constructing RC curbs 4 (including rebar-planting and grouting); (7) setting layout of and installing Z-shaped iron parts; (8) applying fire-resistive coating to the steel box columns and the H beams 1 for each story; (9) setting out Type 125 steel C profiles (including the steel C profiles 5 in the external walls C) with predetermined intervals, performing vertical calibration, and fixing them in position for each story; (10) setting out Type 125 steel C profiles (including fitting transoms and fixing iron parts) at the facade of any opening, door, or window, and reserving construction openings, wherein only when the distance to the site boundary is greater than 150 cm can a window or door to be set; (12) stuffing assembly gaps between the adjacent outer wall panels 61 with elastic cement (stuffing assembly gaps between the adjacent outer wall panels 61 with tile gripper); (13) stuffing assembly gaps between the adjacent outer wall panels 61 with; (14) arranging rockwool strips 7 along the height of the external walls C with elastic cement (closing the assembly gaps between the adjacent outer wall panels 61 with anti-crack nets); (15) fastening concrete inner wall panels 62; (16) constructing fire protection stuffing for all assembly gaps between the main body A, the floor slabs B, and the external walls C; (17) spraying waterproof coating on the outer wall panels 61 across the building; (18) painting the outer wall panels 61 with natural paint; (19) closing the construction openings; and (20) finishing construction of the external wall of the present story.

Figure 6:
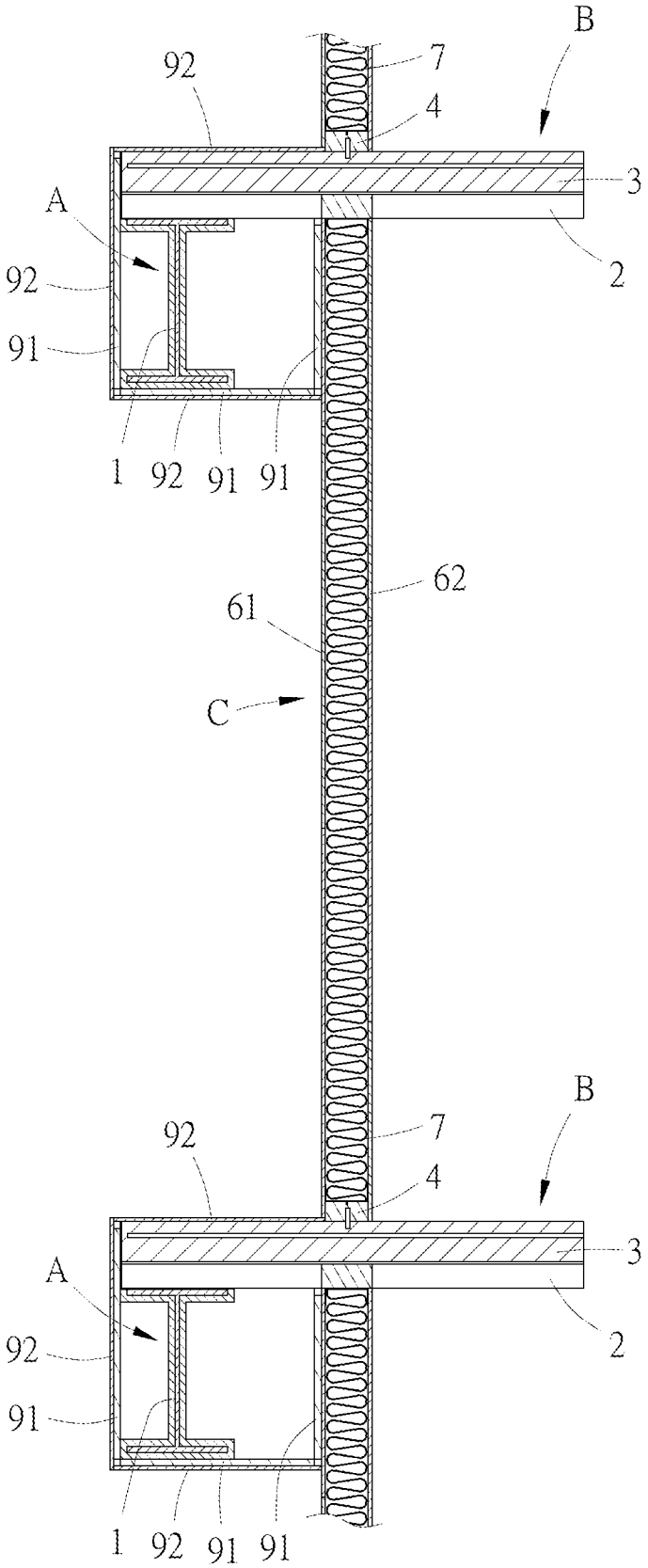
FIG. 6 is a local cross-sectional view of a steel-structure building envelope according to a third embodiment of the present invention.
Figure 7:
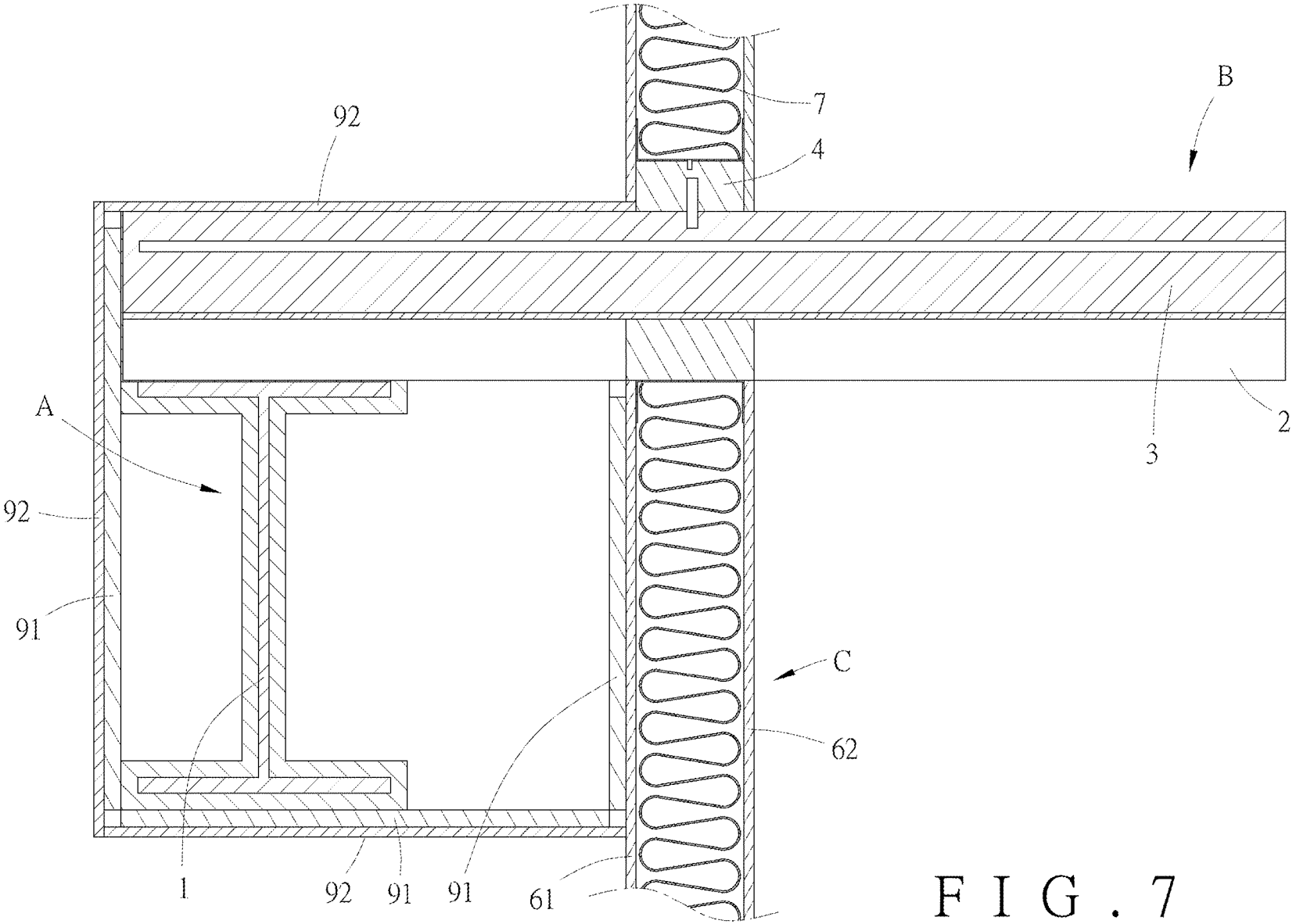
FIG. 7 is another local cross-sectional view of the steel-structure building envelope according to the second embodiment of the present invention.
Figure 8:
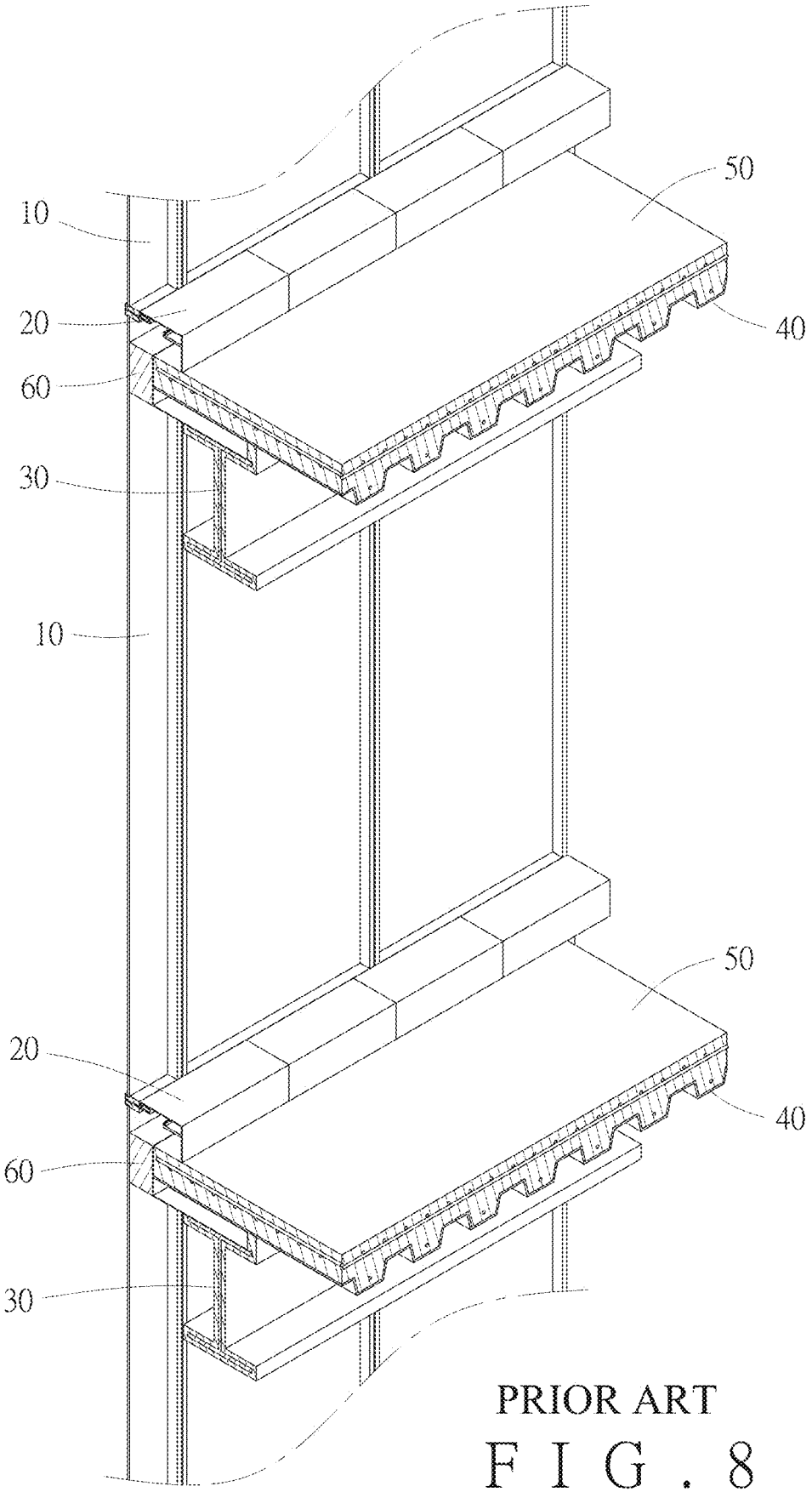
PRIOR ART F I G . 8
FIG. 8 is a local cutaway view of a conventional steel-structure building taken from one view point.
Figure 9:
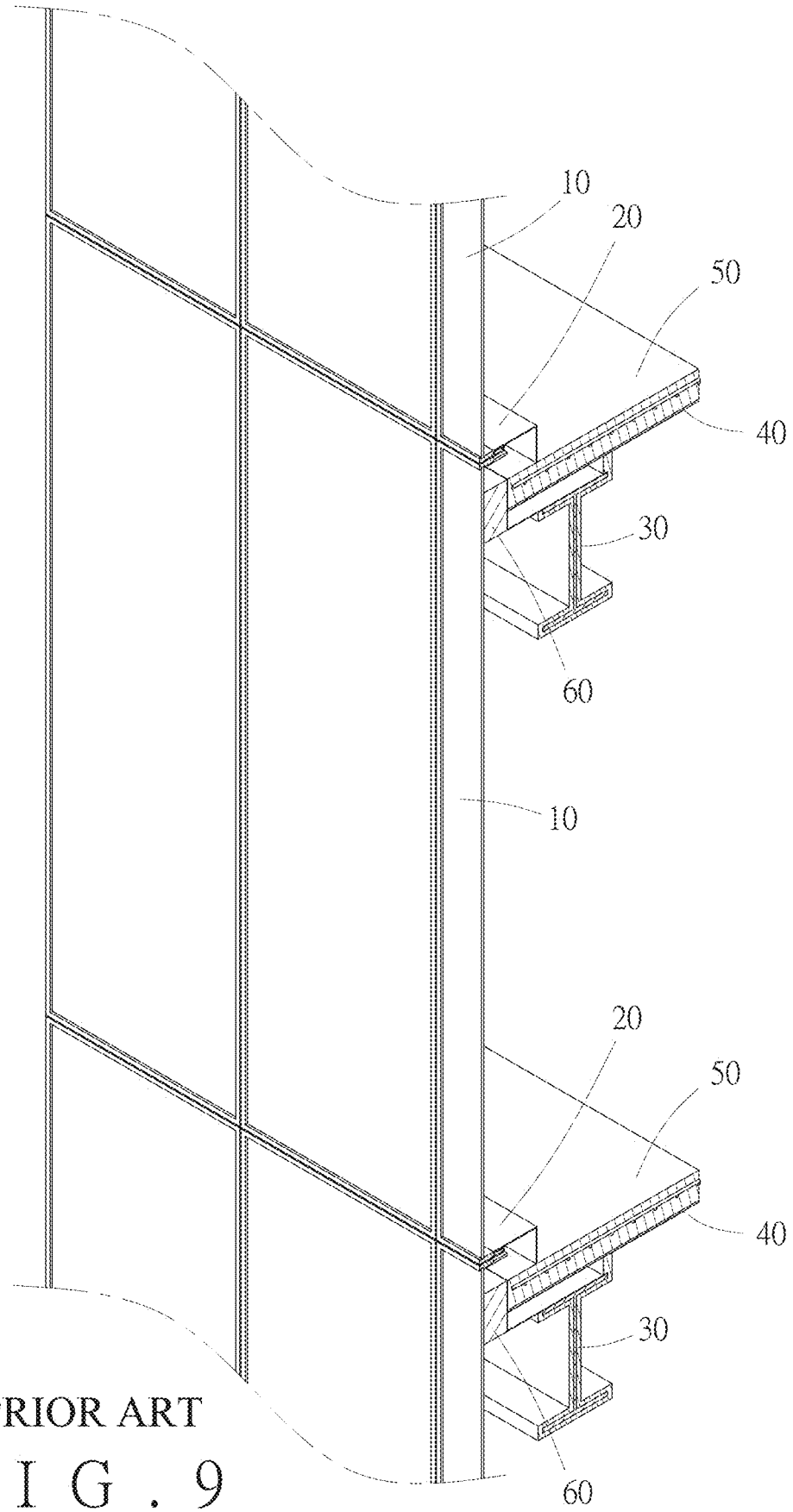
PRIOR ART F I G . 9
FIG. 9 is another local cutaway view of the conventional steel-structure building taken from another view point.
Figure 10:
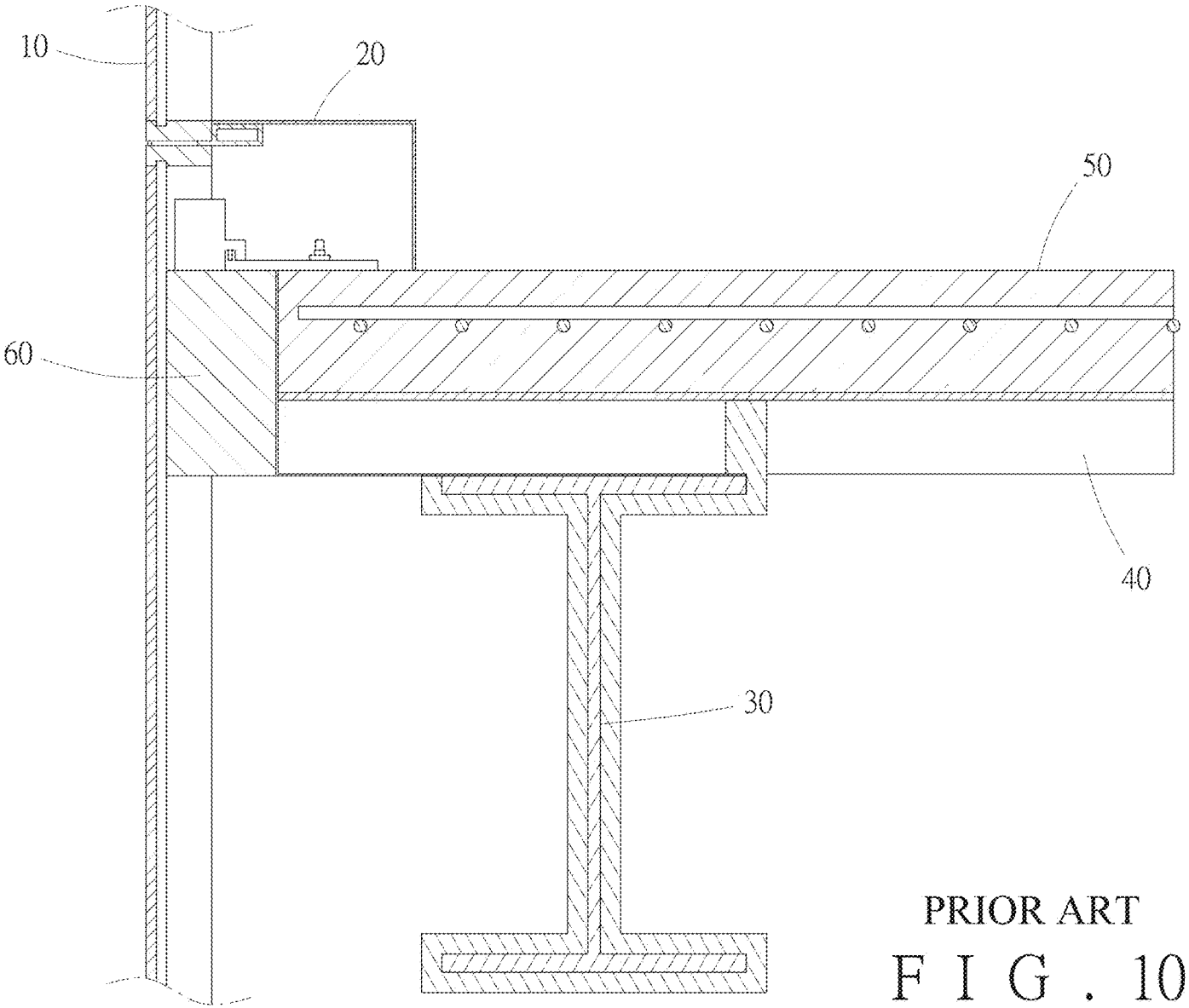
PRIOR ART FIG. 10
FIG. 10 is a local cross-sectional view of the conventional steel-structure building.

In a third embodiment of the present invention, a steel-structure building envelope as shown in FIG. 6 and FIG. 7 is similar to the first embodiment except that the H beams 1 in the present embodiment are installed at the outdoor side of the building and adjacent to the outer wall panels 61, and that each of the H beams 1 is peripherally enclosed by a galvanized square pipe 91, and a concrete panel 92 is attached to the outmost part of the galvanized square pipe 91. By placing the H beams 1 at the outdoor side of the building, the interior can have no or fewer ceiling beams, making the interior of the building more unobstructed, and more desirable as a living space from the perspective of Feng Shui, or Chinese geomancy.

Construction of the present embodiment is implemented as below, with details identical or similar to those known by people skilled in the art of SS construction omitted in the description and left out from the drawings for not blurring characteristics of the present embodiment. (1) assembling steel box columns and H beams 1 for each story; (2) laying decks 2 and pour stops for each story; (3) setting the layout and piping; (4) laying reinforcing bars (or welded wire fabrics) for each story; (5) concreting the RC slab 3 for each story; (6) putting up scaffolds; (7) constructing RC curbs 4 (including rebar-planting and grouting); (8) setting layout of and installing Z-shaped iron parts; (9) applying fire-resistive coating to the steel box columns and the H beams 1 for each story; (10) setting out Type 125 steel C profiles (including the steel C profiles 5 in the external walls C) with predetermined intervals, performing vertical calibration, and fixing them in position for each story; (11) setting out Type 125 steel C profiles (including fitting transoms and fixing iron parts) at the facade of any opening, door, or window, wherein only when the distance to the site boundary is greater than 150 cm can a window or door to be set; (12) assembling concrete outer wall panels 61; (13) stuffing assembly gaps between the adjacent outer wall panels 61 with elastic cement (stuffing assembly gaps between the adjacent outer wall panels 61 with tile gripper); (14) stuffing assembly gaps between outer wall panels 61 with elastic cement (closing the assembly gaps between the adjacent outer wall panels 61 with anti-crack nets); (15) arranging rockwool strips 7 along the height of the external walls C; (16) fastening concrete inner wall panels 62; (17) fastening aluminum window fittings; (18) installing aluminum window frames and doorframes; (19) caulking doors and windows; (20) installing drip lines for doors and windows; (21) constructing fire protection stuffing for all assembly gaps between the main body A, the floor slabs B, and the external walls C; (22) enclosing the H beam 1 with a galvanized square pipe 91, and then attaching a concrete panel to the outmost part of the galvanized square pipe 92: (23) arranging drip lines; (24) spraying waterproof coating on the outer wall panels 61 across the building; (25) stuffing silicone around aluminum window frames and doorframes; (26) painting the outer wall panels 61 with natural paint; (27) removing the scaffolds; (28) finishing construction of the external wall of the present story.

Through the foregoing embodiments that describes various implementations of the present invention, it is clear that the disclosed steel-structure building enclosure helps to solve the problems of traditional steel-structure buildings. The advantages of the present invention include: 1. Decreasing the inter-story drift between stories; 2. eliminating the need of perimeter fire barriers between upper and lower stories; 3. improving waterproofing inside/outside the building; 4. enhancing acoustic/thermal insulation between upper and lower stories and inside/outside the building; 5. And reducing the amount of silicone to be used on the external walls and simplifying maintain. Thereby, the steel-structure building envelope of the present invention satisfies the requirements for residential buildings and helps increase residential building life and achieve net zero emissions.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A steel-structure building envelope of a steel-structure building, comprising:

a building body, having H beams and decks, the decks being assembled onto the H beams;

floor slabs, having reinforced concrete (RC) slabs laid on the decks, so that the decks and the RC slabs jointly act as the floor slabs; and external walls, each comprising:

an RC curb, formed on one of the RC slabs by means of casting;

two steel C profiles, one of which is installed on the RC curb with an opening thereof facing upward, and the other of which is mounted on the deck with an opening thereof facing downward; and an outer wall panel and an inner wall panel, attached to opposite sides of the RC curb and the two steel C profiles, respectively, so that a hollow space is formed between the outer wall panel and the inner wall panel;

whereby the outer wall panel and the inner wall panel have a two-layer structure defining said outer wall panel and said inner wall panel which are affixed directly to the floor slabs.

2. The structure of claim 1, wherein two rockwool strips are attached to the two steel C profiles, respectively, and partially received in the hollow space, so that the two rockwool strips extend along a height direction of the external walls.

3. The structure of claim 2, wherein the two rockwool strips each extend along the height of the external walls C while being bent into a continuous S-shaped form.

4. The structure of claim 1, wherein the H beams are arranged at an indoor side of the building and adjacent to the outer wall panels, and each of the outer wall panels is attached to the RC curb, the two steel C profiles, and the two rockwool strips from an end of the floor slab.

5. The structure of claim 4, wherein a transverse aluminum extrusion is arranged between the two outer wall panels that are adjacent to each other in a height direction thereof.

6. The structure of claim 5, wherein silicone is filled between the transverse aluminum extrusion and the two outer wall panels.

7. The structure of claim 1, wherein the H beams are arranged at an indoor side of the building and adjacent to the outer wall panels, and the floor slabs jut out of the outer wall panels.

8. The structure of claim 1, wherein the H beams are arranged at an outdoor side of the building and adjacent to the outer wall panels.

9. The structure of claim 8, wherein each of the H beams is peripherally enclosed by a galvanized square pipe, and a concrete panel is then attached to an outmost part of the galvanized square pipe.

10. The structure of claim 1, wherein elastic cement is injected to fill assembly gaps between the adjacent outer wall panels.

11. The structure of claim 1, wherein a waterproof layer is applied to coat the outer wall panels of the entire steel-structure building, and further painted with natural paint.

* * * * *